United States Patent [19]

Franc

[11] Patent Number: 4,665,992

[45] Date of Patent: May 19, 1987

[54] METHOD AND APPARATUS FOR INSTALLING PACKERS IN A WELL

[75] Inventor: Jean Franc, Paris, France

[73] Assignee: Schlumberger Technology Corporation, Houston, Tex.

[21] Appl. No.: 693,704

[22] Filed: Jan. 22, 1985

[30] Foreign Application Priority Data

Jan. 20, 1984 [FR] France ..... 84 00926

[51] Int. Cl.[4] ..... E21B 23/06

[52] U.S. Cl. ..... 166/387; 166/122

[58] Field of Search ..... 166/120, 122, 212, 387

[56] References Cited

U.S. PATENT DOCUMENTS

| | | | |
|---|---|---|---|
| Re. 25,846 | 8/1965 | Campbell . | |
| Re. 26,379 | 4/1968 | Cochran . | |
| 2,095,244 | 10/1937 | Dillon . | |
| 2,194,331 | 3/1940 | Strom . | |
| 2,783,028 | 2/1957 | Jamison . | |
| 2,784,790 | 3/1957 | Boer . | |
| 2,831,540 | 4/1958 | Huber . | |
| 3,324,949 | 6/1967 | Davis . | |
| 3,399,729 | 9/1968 | McGill | 166/120 |
| 4,142,583 | 3/1979 | Brieger | 166/120 |
| 4,378,850 | 4/1983 | Barrington | 166/321 |
| 4,402,517 | 9/1983 | Wood et al. | 166/122 |
| 4,436,149 | 3/1984 | Edwards | 166/120 |
| 4,512,399 | 4/1985 | Gano et al. | 166/120 |

FOREIGN PATENT DOCUMENTS 1538017 8/1968 France .

*Primary Examiner*—Stephen J. Novosad
*Assistant Examiner*—William P. Neider

[57] ABSTRACT

Remote control of hydraulically set packers is achieved by incorporating a hydraulic energy accumulator into a well tubing string. A hydraulic line connecting the accumulator with the packers setting mechanism is blocked by a shearable plug connected between the accumulator body and a movable control sleeve. In one embodiment, upward force exerted on the cable of a shifting tool latched into the control sleeve causes the plug to shear and pressure from the accumulator to set the packers. In another, the plug is sheared by movement of the sleeve through contact with a pressure differential sensitive piston that shifts in response to an increase in annular pressure.

9 Claims, 5 Drawing Figures

T
DP1
SJ
DP2
RV
DP3
DP3
1
DST-1
DST-2
19
PR
HJ
SJ
2
STP

METHOD AND APPARATUS FOR INSTALLING PACKERS IN A WELL

BACKGROUND OF THE INVENTION

1. Technical Field

This invention relates to the installation of packers in a well. Packers are seals which are placed between the casing of a well and the production tubing so that the tubing communicates only with the hydrocarbon-bearing subsurface strata. It is of course necessary to proceed with the installation or setting of these packers at the desired depth in the well.

2. Background Information

Some so-called permanent packers are placed during the first lowering. They are installed at the desired depth by an explosive or hydraulic control. They exhibit different drawbacks which make them difficult to use for drill stem testing operations before production when a perforation system carried by the drill string is used. In any case, the inner diameter available to go through the packer remains small. In a variant, these packers can be made retrievable, which does not however eliminate the drawbacks mentioned.

At the present time, for the above-mentioned testing operations, mechanically-controlled packers are used, these tools moreover being retrievable. However, the actuation of these tools requires significant rotational and translational movements of the drill string. This results in serious difficulties when it is desired to use such tools in land wells which are deviated or which exhibit slope discontinuities. Furthermore, for offshore operations, the ship or the semi-submersible drilling unit is itself subjected to non-controllable movements in relation to the sea bottom and the conventional hydraulic control lines used do not allow significant rotational movements of the drill string. In short, the movements necessary for controlling tools of this type, i.e. rotational, pulling and pushing movements on the production tubing, make them incompatible with many applications in which they would be very useful.

There are also hydraulically controlled packer devices. The control is obtained by placing the tool string under pressure. However, the application of these tools is not possible in the case of the above-mentioned testing operations for the following reasons: the tool string making up the production tubing is then lowered with a downhole valve at its lower end, the valve being closed during the lowering. With the production tubing empty or almost empty, it is practically out of the question to pressurize it. Moreover, the tests often require the incorporation, within the tool string, of pressure-sensitive devices, which are poorly suited to pressurizing within the drill string.

SUMMARY OF THE INVENTION

It is an object of the present invention to provide an apparatus and a method not subject to the above-described drawbacks and making it possible to place packers without having to manipulate the production tubing and without having to use explosive means of hydraulic lines extending down from the surface.

The proposed apparatus is of the type comprising a packer equipment designed to be inserted in a drill string lowered into a well, said equipment comprising hydraulic means for compressing the packers against the internal wall of the well casing so as to ensure sealing, between the parts over and under the packers, of the annular space between the drill string and the internal wall of the casing.

According to one feature of the invention, a hydraulic control apparatus is inserted in the drill string under or over the packer. This apparatus comprises means for accumulating hydraulic energy, a hydraulic line connecting these accumulation means with the packer compression means and controllable means for maintaining hydraulic energy in the accumulation means and then for releasing this energy in the hydraulic line.

According to one aspect of the invention, these control means include, upstream of the tool, an annular chamber housing a free piston and forming an oleopneumatic accumulator, and controllable means comprising a shearable plug capable, after shearing, of transmitting the hydraulic pressure from the chamber to the tube. The control proper can be obtained by means of an internal sleeve capable of moving axially to break the plug, this sleeve making it possible to remotely control the setting of the packers without pressurizing the production tubing.

In a first embodiment, the control sleeve has, on its internal wall, a hollow shoulder which allows its actuation by dogs lowered at the end of a cable (currently used device called a "shifting tool") inside the production tubing and capable of anchoring in the hollow shoulder.

In a second embodiment, downstream of the control sleeve is provided a control piston defining, with the body of the control means, an annular cylinder which communicates with the outside of the production tubing (the annular volume between the tubing and the casing), this piston being retained by a pin which can shear under a predetermined force.

Such an apparatus can be mounted without difficulty upstream of a downhole valve which is normally closed during the lowering of the tool string. It is thus possible to place intermediate tools between the setting tool and its control means. Some of these intermediate tools can be sensitive to pressure. The connection line mentioned above need only go around these tools.

The present invention also provides a method for installing packers in a well, whereby one lowers into the well casing a drill string in which is inserted equipment incorporating the packers and whereby means for compressing the packers are actuated hydraulically.

According to the invention, one lowers simultaneously with the equipment and incorporated in the drill string, a reserve of hydraulic energy and one controls, from the surface, the release of the energy to actuate the compression of the packers.

The two embodiments described above are utilizable in connection with the method. The same applies to the different variants concerning the existence of a downhole valve, as well as intermediate tools between the packer apparatus and its control means.

When the control of the packer apparatus by varying the thrust prevailing in the annular space (between the drill string and the casing) is used jointly with other downhole tools involving a control by a variation of the pressure prevailing in the annular space, it is possible to act on the relative differences in the pressure levels. More precisely, a first pressure level could correspond to the setting of the packers, according to the second embodiment described. A second pressure level will correspond to the opening of pressure-sensitive downhole valves placed between the packer apparatus and its control means. A third pressure level may correspond to the execution of perforations in the casing, for example by firming a hydraulically-operated explosive system. These three pressure levels are of course mentioned in increasing order.

BRIEF DESCRIPTION OF THE DRAWINGS

Other characteristics and advantages of the invention will appear from the following detailed description given in connection with the appended drawings in which.

DESCRIPTION OF PREFERRED EMBODIMENTS

Figures 1A, 1B:
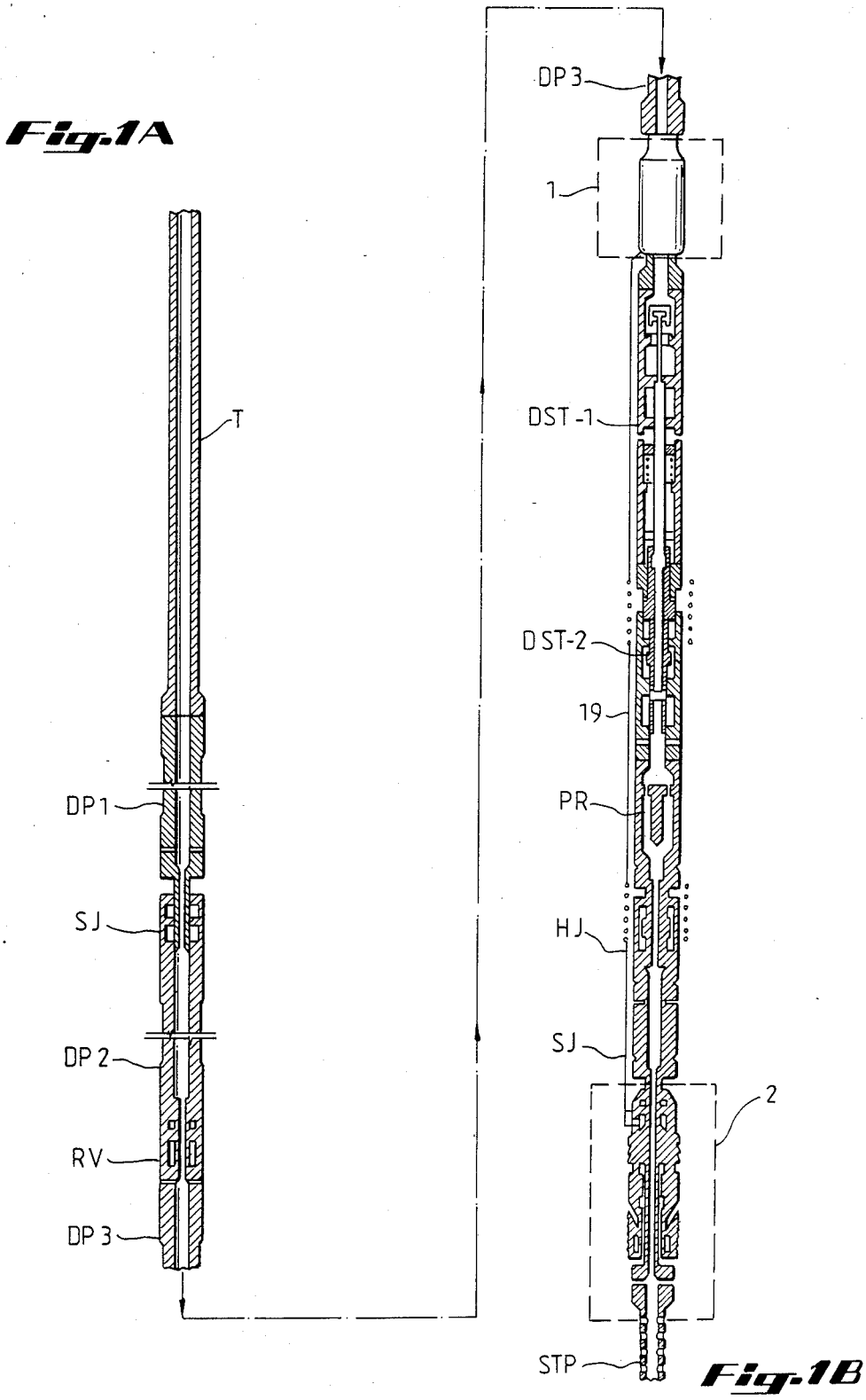
FIGS. 1A and 1B illustrate in a very schematic form a complete example of the tool string which can be used during drill stem testing (DST)

In FIG. 1A, reference T designates the string of a production tubing. The string T is followed by several sections of drill collars DP1 to DP3 between which are placed, for example, a slip joint SJ and a reversing valve RV allowing backflow by internal pressure cycling.

As shown in FIG. 1B, the pipe section DP3 is followed by the control means 1 according to the invention. After these, is first of all placed the DST tool, which comprises a test device (downhole valve) controlled by the annular pressure DST-1 and a hydrostatic reference tool DST-2. A pressure recorder PR is then provided. It is also optionally possible to add a hydraulic jar HJ, as well as a safety joint SJ. We then have the packer apparatus according to the invention, shown by reference numeral 2, which is followed by a perforated pipe STP under which may be placed pressure recorders.

A line or pipe 19 connects the devices 1 and 2 of FIG. 1B. It is noted that this pipe is advantageously wound helically at the level of the devices DST-2 and HJ to allow variations in the length of the production tubing.

Figure 2:
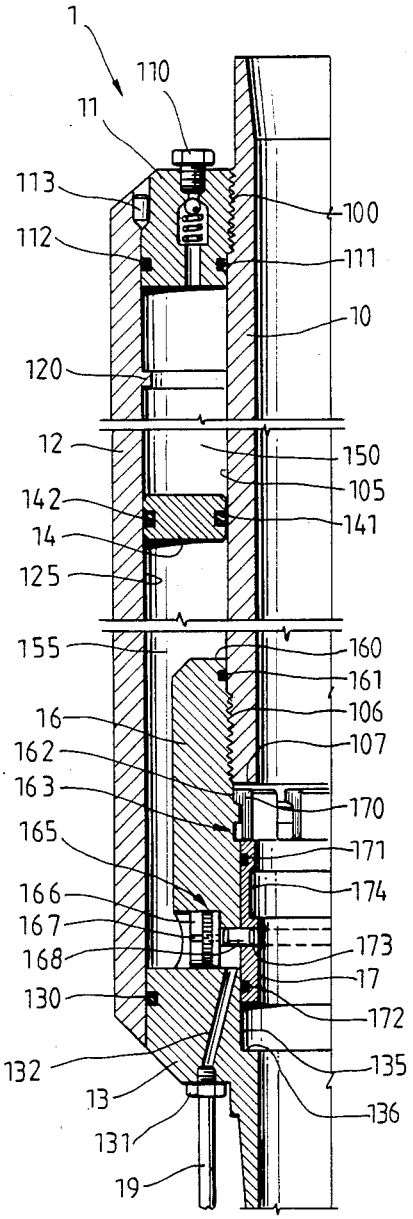
FIG. 2 illustrates, in the form of a longitudinal-section half-view, the control means of an embodiment of the apparatus according to the invention.

FIG. 2 shows a main mandrel or pipe 10, whose head is equipped with threading 100 on which is placed an annular end fitting 11. On the outside, the annular fitting 11 receives a cylindrical wall 12. This same fitting has seals 111 and 112 respectively on the side of the pipe 10 and of the wall 12. A holding screw 113 maintains the end fitting 11 and the wall 12 solidly together. Finally, the fitting 11 is equipped with a system forming a pressurized nitrogen admission valve, denoted 110 as a whole.

The cylindrical wall 12 has, on its inside 125, a shoulder 120. In the annular space delimited by the inside 125 of the wall 12 and the outside 105 of the pipe 10, slides a free or floating piston 14 equipped on each end side with seals 141 and 142. The upward movement of the piston 14 is limited by the shoulder 120. Over this piston is defined a nitrogen chamber 150 which is filled in advance by means of the valve 110.

Under the piston 114 is defined a chamber 155 filled with oil as further described below.

At the bottom of the main pipe 10 there is a threading 106 on which is fitted an annular piece 16 after the insertion of a seal 161. The top face 160 of this piece 16 defines the internal stop of the piston 14. The chamber 155 extends into the annular space remaining free between the piece 16 and the cylindrical wall 12. In the lower part, this annular space reaches the level of a bore or hollow 165 provided in the piece 16. This hollow houses a sealed shearable plug 166. This plug is pierced with a central orifice 167 leading into a shearable nipple 168 of the plug.

At its lower end, the cavity 155 is closed by the lower end 13 of the piece 16 provided with a seal 130 on the side of the wall 12. A bore 135 is made on the inside of the piece 16. Along this bore slides a control sleeve 17 equipped with seals 171 and 172 with respect to the shearable plug 166. The control sleeve 17 has an annular recess or hollow 173 into which fits the nipple 168 of the shearable plug 166. It will also be noted that the plug 166 blocks communication of the bore 165 with a tubular channel 132 provided in the end piece 13, and to which is connected the pipe 19 by means of the attachment device 131. The downward movement of the control sleeve 17 is limited by a shoulder 136 of the end piece 13. In its rest position, this sleeve 17 is checked from moving upward by the elastic fingers 170 near the lower end 107 of the main pipe 10. These elastic fingers 170 are provided with a shoulder at their outer ends, fitting at rest into a notch or hollow 162 defined by the piece 16 and by the stop 107. After a downward movement, the shoulders of the elastic fingers 170 fit into a lower notch 163.

Finally, in the embodiment represented in FIG. 2, the control sleeve 17 is provided with an annular groove or hollow 174 on its inside wall. This hollow is designed to receive the dogs of a shifting tool (not shown) which may be lowered in the retracted position by means of a cable inside the entire drill string to fit into the hollow 174 when controlled actuation of the accumulator is desired. After their anchoring in the hollow, these dogs make it possible to exert a predetermined downward thrust on the control sleeve 17 resulting in the breaking of the nipple 168 of the pin 166. This downward thrust allows communication between the chamber 155 and the pipe 19 which is thus placed under a predetermined fluid pressure. Of course, the filling of the chamber 155 will have been carried out previously from the surface through an orifice with a nonreturn valve and a plug (not shown). The nitrogen pressure will have been set according to the utilization depth and the weight of the hydrostatic column of fluid in the well, by conventional means for loading the oleopneumatic accumulators.

The line 19 connects the apparatus of the invention to the packer apparatus and more precisely to the hydraulic control part of the latter. The hydraulic control part includes, in a conventional and simplified manner, a piston moved by the hydraulic fluid in the line 19. This piston pushes the packers to compress them in the longitudinal direction of the well, thereby causing their expansion and hence their compression on the inside wall of the casing. The packer apparatus with hydraulic control is a tool used currently in the oil industry.

Figure 3:
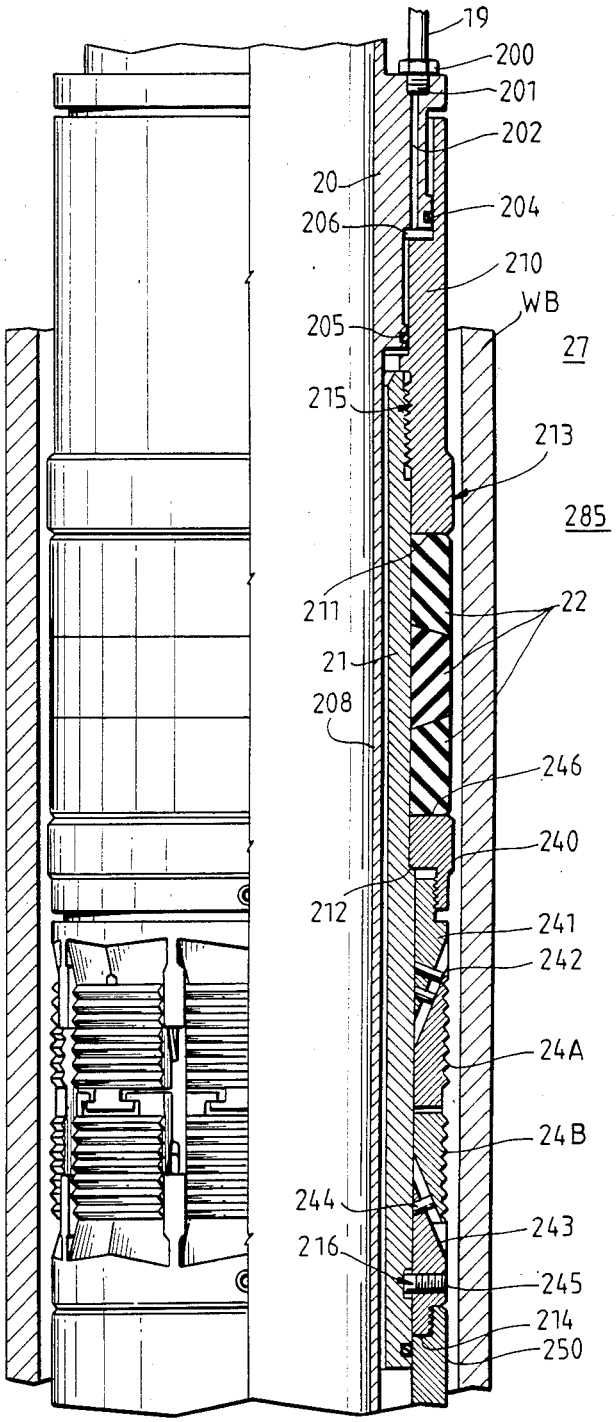
FIG. 3 illustrates, in the form of a longitudinal view, a packer apparatus according to the present invention, the left-hand half of this figure being an external view and the right-hand half a sectional view.

Reference is now made to FIG. 3 in which the pipe 19 is seen shown extending down to arrive up to a connection 200 on the main pipe 20 of the packer apparatus 2.

The connection 200 is mounted in a threading 201 which communicates with a pipe 202 leading to the radial shoulder 206 of the piece 20. Upstream of this shoulder is provided a bore with a seal 204. Downstream of the shoulder is provided a bore of smaller diameter with a seal, noted 205. Further down, the main pipe 20 extends from 208 to the lower part of the apparatus.

Around the part 208 of the main pipe 20 is placed a sliding actuating sleeve 21. Its upper part is connected, by the threading 215 to a bushing 210 cooperating with the bores adjacent seals 204 and 205 already mentioned. An annular cylindrical chamber is thus defined between the parts 20 and 210 at the level of the shoulder 206. It will be apparent that the pressurizing of the line 19 will result in a downward thrust on the parts 210 and 21.

The surrounding part shown in FIG. 3 represents the well casing, denoted WB.

Further down, the part 210 includes a reinforcement 213 with a slightly enlarged section followed by its terminal part 211. The latter serves as an upper support for packers 22, made in three parts, in a conventional manner. The lower support 246 for these packers consists of a part 240 which is also enlarged. The downward movement of this part 240 is prevented by a shoulder 212 of the actuating sleeve 21. In the rest position illustrated, the packers 22 are not subjected to an axial compressive force.

The part 240 receives, by means of threading, the upper part 241 of the anchoring system for anchoring in the casing WB. The rods 242 having an inclined projection with respect to the part 241 serve as a support for the upper jaws 24A of the anchoring device. The upper jaws 24A are connected to the lower jaws 24B with the possibility of axial approach. In their turn, the lower jaws 24B bear on the inclined rods 244 mounted in the lower part 243 of the anchoring system. In the lower part 243 are provided one or more screwed pins 245 which project internally in the recesses 216 of the actuating sleeve 21. The axial clearance of the part 243 is thus limited, it being observed that this same part can not go any lower than the shoulder defined at 212 in the actuating sleeve 21.

At the bottom of the part 243 is screwed the upper part (not shown) of a sleeve 250. At its lower part, the sleeve 250 is fixed to the pipe 208 itself screwed at the lower part of the drill string, and consequently does not move.

Those of the art will understand the general operation of such a packer apparatus with anchoring on the casing. This operation is thus described only briefly.

The main pipe 20 and its extension 208 do not move and are connected to the sleeve 250 and the lower wedge 243, which is fixed to the sleeve 21 by means of the pin 245. When the control means 1 are actuated, they temporarily place the pipe 19 under pressure.

The corresponding oil pressure is received at chamber 206 and, pushed downward against the assembly made up of the actuating sleeve 21 and the part 210. When the pressure reaches a certain value, the pin 245 fails, thereby releasing the sleeve 21 which can slide downward. The terminal part 211 of the piece 210 then pushes the packers 22 and the anchoring system 24 against the wedge 243 which remains still because it is held by the sleeve 250.

Owing to this thrust, the packers 22 compress and expand until they come into contact with the casing WB. At the same time, the jaws 24A and 24B move toward each other, while moving outward, so that they also become anchored on the casing WB.

A conventional double-pawl threading system (not shown) makes it possible to prevent the backward movement of the actuating sleeve 21 when the pressure is purged on the cylinder 206. This system also allows the withdrawal of the sealing apparatus by pulling or rotating the drill string.

A variant of the control means 1 according to the invention is now described with reference to FIG. 4. This variant differs little from the embodiment described in relation to FIG. 2. Only the differences will be discussed.

Figure 4:
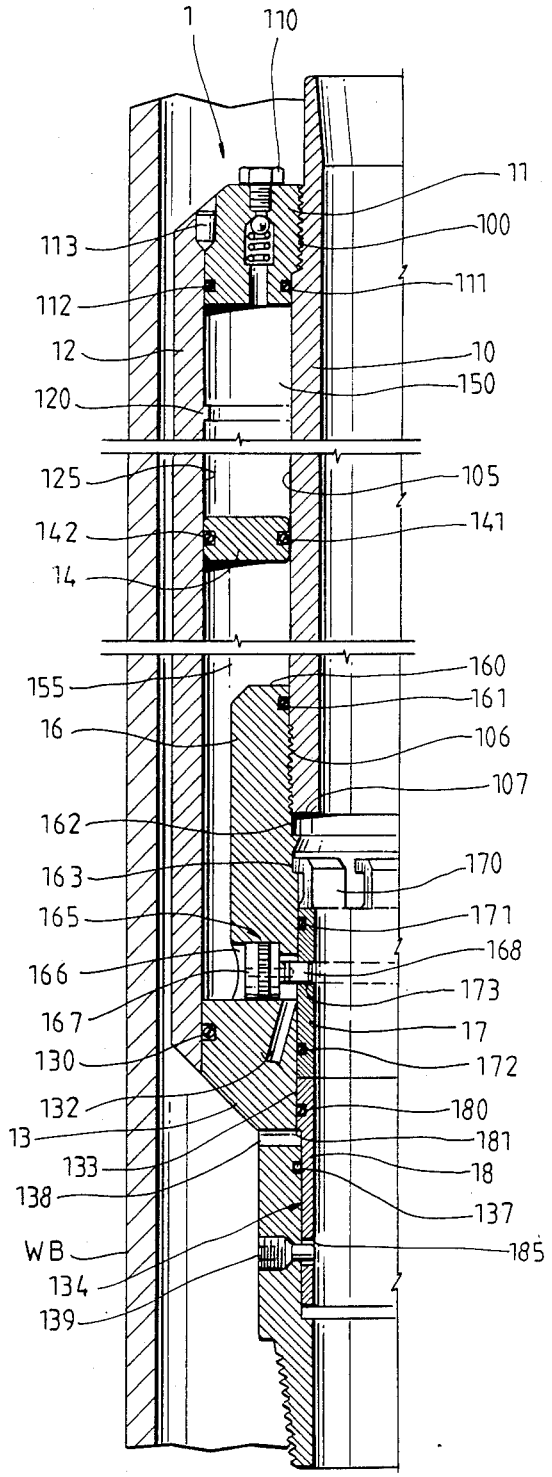
FIG. 4 is a longitudinal half-section of another embodiment of the control means, illustrating the second implementation mentioned above.

It is noted that FIG. 4 shows the well casing WB, not shown in FIG. 2 is shown in FIG. 4.

The position of the shear plug 168 in its recess is slightly different so that this plug can be sheared by upward movement of sleeve 17. The bushing 170 is thus kept engaged on the hollow 163 in the rest position. It will come on to the hollow 162 after actuation.

The passage 132 is only partially shown to allow a better illustration of the lower part of the control means having to do with the essential aspects of the modifications. In this lower part 13 is provided a downward extension which forms, at 134, the bore of a control piston 18 of annular form. The top of this piston has a shoulder 181 followed by a radial outward enlargement cooperating with the bore 133 of the end piece 13. A seal 180 is provided at this level. A passage 138 is provided inside the end piece 13 so that the annular volume between the casing WB and the control means is made to communicate with the jack surface formed by the shoulder 181 of the control piston 18. Below, a seal 137 is provided between this control piston 18 and the bore 134. Further down, the control piston 18 is provided with an orifice 185 cooperating with a shearable shank screw 139.

The operation is the following: at rest, the lower end of the control sleeve 17 bears on the control piston 18. The control is obtained by pressurizing the annular volume between the casing WB and the control means 1. This pressurization results in an upward force on the piston 18 which drives the control sleeve 17 upward and breaks the plug 168. The bushing 170 moves up from the notch 163 to the notch 162 and remains in this position. The pipe 132 is then under pressure and this pressure is transmitted to the pipe 19. The rest of the operation is the same as previously described with reference to the embodiment shown in FIG. 2.

It may be interesting, in the case of DST type operations, to control the operating sequence by using, each time, the pressurizing of the annular volume of the well with three pressure levels in increasing order:

(a) lower pressure level for setting the packers and the associated anchoring;

(b) intermediate pressure level for starting the operation of the test tools;

(c) higher pressure level for firing the explosive charges intended to perforate the casing.

It may be noted that, in both embodiments described and represented, the hydraulic accumulator is located over the packer apparatus. It is obvious that the accumulator may be located below. This is particularly advantageous when the piston actuating the packers of the apparatus is at the bottom of the apparatus.

The apparatus of the invention can also include means for releasing the pressure in the chamber 155 after the packer apparatus has been set. The means may consist of a system similar to the one represented by the elements 166-167-168-17 in FIG. 2.

What is claimed is:

1. Hydraulic control apparatus for the control of packer equipment inserted in a tubing string and lowered into a well, said equipment comprising hydraulic means for compressing a packer element against the wall of the well so as to ensure sealing, between the parts of the well above and below said packer element, of the annular space between said tubing string and said wall; said hydraulic control apparatus being adapted to be inserted in said tubing string above or below said packer equipment, and comprising:

means for accumulating hydraulic energy, comprising a body having an annular chamber and a free piston housed within said chamber, and forming an oleopneumatic accumulator;

a hydraulic line connecting said accumulation means with said packer compression means; and means for controllably transmitting the hydraulic pressure from said accumulation means to said hydraulic line, comprising a shearable plug blocking said transmission until shearing, a sleeve, and means for selectively moving said sleeve to break said plug, selective movement of said sleeve making it possible to remotely control the means for compressing the packer element against the well wall.

2. Apparatus according to claim 1, wherein said means for selectively moving said sleeve comprises means for moving said sleeve in response to the actuation of a shifting tool lowered at the end of a cable from the surface inside said tubing string.

3. Apparatus according to claim 2, wherein said sleeve is formed with a recess and positioned with said recess exposed to the bore of said tubing string to enable a shifting tool with a dog to engage said dog in said recess.

4. Apparatus according to claim 1, wherein said means for selectively moving said sleeve comprises means for moving said sleeve in response to the application of a predetermined pressure to the annular space between said tubing string and said wall.

5. Apparatus according to claim 4, wherein said means for selectively moving said sleeve further comprising a control piston of substantially cylindrical form positioned in contact with said sleeve and placed inside said body in communication with said annular space by means of an opening in said body, so as to cause the shifting of said sleeve by movement of said control piston in response to application of the predetermined pressure.

6. Apparatus according to claim 5, wherein said means for selectively moving said sleeve further comprises a shearable element holding said control piston against movement relative to said body until said predetermined pressure is applied.

7. In a method for installing a packer element in a well, comprising the step of lowering into the well a tubing string incorporating said packer element and the step of hydraulically actuating a mechanism for compressing the packer element against the wall of the well, the improvement comprising the steps of:

lowering, simultaneously with lowering said packer element incorporated in said tubing string, means for storing a reserve of hydraulic energy, said means being of annular form placed around said tubing string so as to leave a full bore passage inside said tubing string;

storing a reserve of hydraulic energy within said storing means; and controlling from the surface the release of said energy reserve to actuate the compression of the packer element against the wall of the well by breaking a plug located between said storing means and said packer element compressing mechanism.

8. A method according to claim 7, wherein the release of the hydraulic energy is actuated by lowering from the surface means, suspended at the end of a cable, which hook onto said plug, and exerting a force on the cable to break said plug.

9. A method according to claim 7, wherein the release of the hydraulic energy is actuated by increasing the relative pressure difference between the inside and the outside of said tubing string and causing said plug to be broken by moving a piston sensitive to said relative pressure.

* * * * *